United States Patent [19]

Inoue

[11] 4,021,040

[45] May 3, 1977

[54] BARBELL WITH REMOVABLE WEIGHTS AND A SPRING TYPE GRIPPING DEVICE

[76] Inventor: Kenjiro Inoue, No. 52, Naka 4-chome, Nagai-cho, Sumiyoshi, Osaka, Japan

[22] Filed: Dec. 12, 1974

[21] Appl. No.: 531,852

[30] Foreign Application Priority Data

Aug. 2, 1974 Japan ..... 49-93043[U]

[52] U.S. Cl. ..... 272/123; 272/68; 272/135

[51] Int. Cl.[2] ..... A63B 13/00

[58] Field of Search ..... 272/84, 67, 81, 68, 272/83, 123, 136, 135

[56] References Cited

UNITED STATES PATENTS

| | | | |
|---|---|---|---|
| 1,113,791 | 10/1914 | Latella | 272/84 X |
| 2,926,911 | 3/1960 | Reichel | 272/83 X |
| 3,687,458 | 8/1972 | Proctor | 272/68 X |

FOREIGN PATENTS OR APPLICATIONS

| | | | |
|---|---|---|---|
| 598,554 | 1959 | Italy | 272/84 |

*Primary Examiner*—Richard C. Pinkham
*Assistant Examiner*—William R. Browne
*Attorney, Agent, or Firm*—George B. Oujevolk

[57] ABSTRACT

A dumbbell provided with a weight at both end portions thereof. The weight is detachable from the dumbbell so as to make it adjustable in weight in accordance to the weight dealing capacity of a trainee. This dumbbell is also equipped with a grip promoting member at the grasping portion thereof also detachably therefrom, thus this invention is meaningful from the view point of economy and efficiency in training. The dumbbell has a handle and a threaded bar at each end thereof to receive threaded weights. Each unit of weights at each end of the bar is spherically shaped. Each unit of weight is composed of a plurality of parallel sections passing through the sphere. The axis of each sphere coincides with the longitudinal axis of the handle. The weights of each unit are in abutting relationship. The grip includes a spring and is mounted in a cantilevered manner to the handle. One end of the spring is detachably anchored in a reduced section of the handle at a position toward one end of the handle. The grip has a finger receiving portion.

1 Claim, 4 Drawing Figures

BARBELL WITH REMOVABLE WEIGHTS AND A SPRING TYPE GRIPPING DEVICE

This invention relates to a dumbbell as a piece of gymnastic equipment for the purpose of improving muscular strength, and in particular a dumbbell provided with weights and a grip promoting unit both detachably therefrom so as to make the dumbbell adjustable in accordance with the user's strength and capacity.

Thus the piece of equipment herein contemplated is apparently distinctive from conventional a dumbbell which usually is nothing but a bar with balls at both ends thereof.

Thus, an object of this invention is to provide a dumbbell having detachable weights so that the dumbbell may change its weight at need to accord with the user's strength and capacity.

A second object of this invention is to provide a dumbbell further provided with a detachable grip promoting unit thereon.

These objects of this invention can be accomplished by the improvement, combination and operation of every part constituting this invention, the preferred embodiment of which will be readily understood in the accompaying drawing and further in the explanation given in relation to said drawing.

Figure 1:
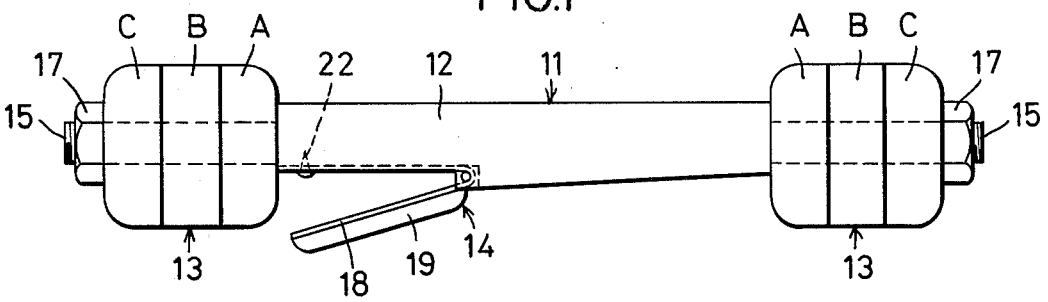
FIG. 1 is a front view of this invention in a first embodiment.
Figure 2:
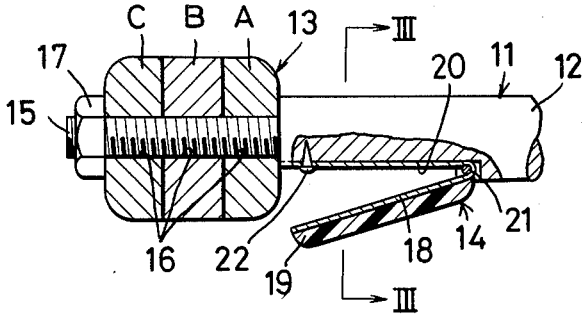
FIG. 2 is a longitudinal front of the above showing integral parts thereof.
Figure 3:
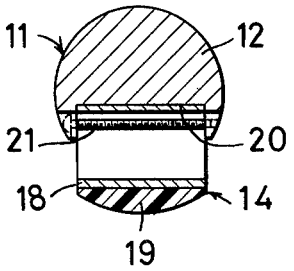
FIG. 3 is a longitudinal side view showing a portion along line III — III in FIG. 2.

In the first embodiment illustrated in FIG. 1 -3, numeral 11 designates the dumbbell proper, comprising a hadle 12, weights 13 mounted on grasp 12 at both ends thereof, and a grip promoting unit 14 on the handle 13 adjacent one end portion thereof.

The handle 12 has a sectional form and length both being suitable for grasping, said handle 12 being adapted wth an axially projective spiral shaft 15 at both ends thereof.

The weight 13 consists of a plural number of units which are the same as may be different from each other in weight, said units being separable from the handle 12 and also from each other.

In this embodiment, the units are 3 in total designated by letters A, B, C in the drawing, said units A, B, C each having a corridor 16 of a spiral inside periphery is axially hollow from side to side all through said units A, B, C, the spiral shaft 15 penetrating therethrough thereby securing said units A, B, C to the spiral shaft 15. A screw 17 additionally is fitted to the extreme outer edge of spiral shaft 15 for further adding to the securing state of weight 13.

The grip promoting unit 14, shown in FIGS. 2 and 3, is formed by a leaf spring 18 in a folded state, the outward strip thereof at its outward side being provided with a finger applying portion 19 made of synthetic resin lapping thereover.

This grip promoting unit 14 is fixed to the handle 12 in such a manner that the handle 12 has a recess portion 20 in the axial direction on the outer periphery of handle 12 adjacent one end portion thereof. In said recess portion 20 the inward piece of a folded leaf spring 17 is fastened with a screw 22 in the flat state with the leaf spring 17 folded in said recess portion 20 and held at its edge with a screw 21. Needless to mention, recess portion 20 is shaped so as to just fit to receive the grip promoting unit 18 therein.

This grip promoting unit 14 may be replaced with another one differing in spring force. A coil spring (not shown) may take the place of the foregoing leaf spring for forming the grip promoting unit 14.

The above-described dumbbell is useful for the promotion and improvement of muscular strength in such a manner that the dumbbell adjusted as desired in weight with the combination of said weight units is grasped at the handle 12 by an arm in the stretched state, said dumbbell being swung thence vertically and horizontally for training muscular strength centering around the arm.

Also, grip enforcement is obtained by means of grasping the grip promoting unit against the springing force of the leaf spring 18.

Figure 4:
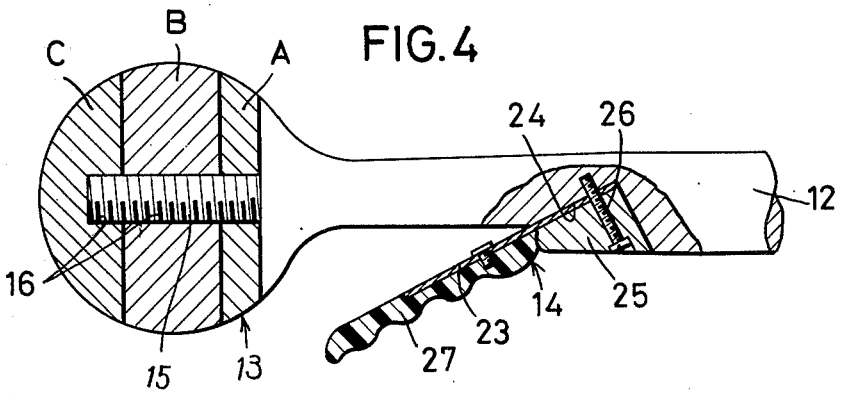
FIG. 4 is a longitudinal front view showing the parts of this invention in a second embodiment.

In the second embodiment of this invention illustrated in FIG. 4, the handle 12 is so formed at its end portion as to be diametrically enlarged, said end portion being provided with an axially projective spiral shaft 15. The weight 13 in the second embodiment forms a ball, also comprising units A, B, C fitting over the spiral shaft 15 threaded axially through the sidewise center of the units A, B, C for detachable fixing to the shaft 15. In this case, however, the spiral shaft 15 comes to a stop within unit C wherein the hollow portion 16 ends as shown in FIG. 4.

The grip promoting unit 14 is formed by a flat leaf spring 23, said leaf spring 23 at its base portion lapping over the inclined surface of a recess portion 24 formed on the under surface of the handle 12, the unit 14 being detachably fixed at the base end thereof to the handle 12 by means of a screw 26 which pierces through a holding member 25 into the handle 12. The leaf spring 23 at the other end thereof projects outward aslant from under surface of the handle 12, said projective portion at its underside surface being provided with finger applying portion 27.

This invention thus enables the training of muscles in the most effective manner, i.e. the adjustment of weight of the dumbbell in accordance to the trainee's strength capacity, without it being necessary to replace the entire dumbbell to the profit of its user.

What is claimed is:

1. A combination dumbbell and grip exerciser for performing lifting and gripping exercises simultaneously, comprising:

a. an elongated handle with a threaded bar at each end having a reduced cross-sectional area in the form of a notch toward one end thereof;

b. globular weight means detachably mounted on the bar at each end of the handle for providing resistance to lifting, each of said globular weight means comprising a plurality of units engaging each other in abutting parallel planes, said units when taken together form a sphere, the axis of said sphere coinciding with the longitudinal axis of the handle, each of the units provided with a threaded aperture for securing the units to said threaded bar, the outermost unit to be secured to the threaded bar without the threaded bar penetrating therethrough;

c. a grip force developer mounted in a cantilevered manner within said reduced cross-sectional area of the handle, said developer comprising a detachable plate spring having a finger receiving portion;

d. a holding member engaging a end portion of said detachable plate spring within the reduced cross-sectional area, such that the detachable plate spring is secured between the reduced cross-sectional area of the handle and the holding member.--

* * * * *